United States Patent [19]

Johnson

[11] 4,274,762

[45] Jun. 23, 1981

[54] PRESTRESSED ROCK TRUSS

[75] Inventor: Stanley F. Johnson, 80 Sydney St., Muswellbrook, New South Wales 2333, Australia

[73] Assignee: Frederick Johnson, Lithgow, Australia

[21] Appl. No.: 15,034

[22] Filed: Feb. 26, 1979

[30] Foreign Application Priority Data

Mar. 3, 1978 [AU] Australia ..... PD3580

[51] Int. Cl.[3] ..... E21D 20/00

[52] U.S. Cl. ..... 405/259; 405/288

[58] Field of Search ..... 405/148, 259, 260, 261, 405/288, 290

[56] References Cited

U.S. PATENT DOCUMENTS

| | | | |
|---|---|---|---|
| 2,371,789 | 3/1945 | Batten | 405/290 |
| 3,427,811 | 2/1969 | White | 405/259 |
| 4,091,628 | 5/1978 | Kelley | 405/290 |

FOREIGN PATENT DOCUMENTS

| | | | |
|---|---|---|---|
| 373421 | 6/1973 | U.S.S.R. | 405/259 |
| 570715 | 9/1977 | U.S.S.R. | 405/259 |

*Primary Examiner*—David H. Corbin

*Attorney, Agent, or Firm*—Ladas & Parry

[57] ABSTRACT

A roof support system for mines in which prestressed rock trusses are bolted to the roof of the mine with roof bolts which each extend beyond the width of the mine gallery and the method of installing said trusses into position.

5 Claims, 8 Drawing Figures

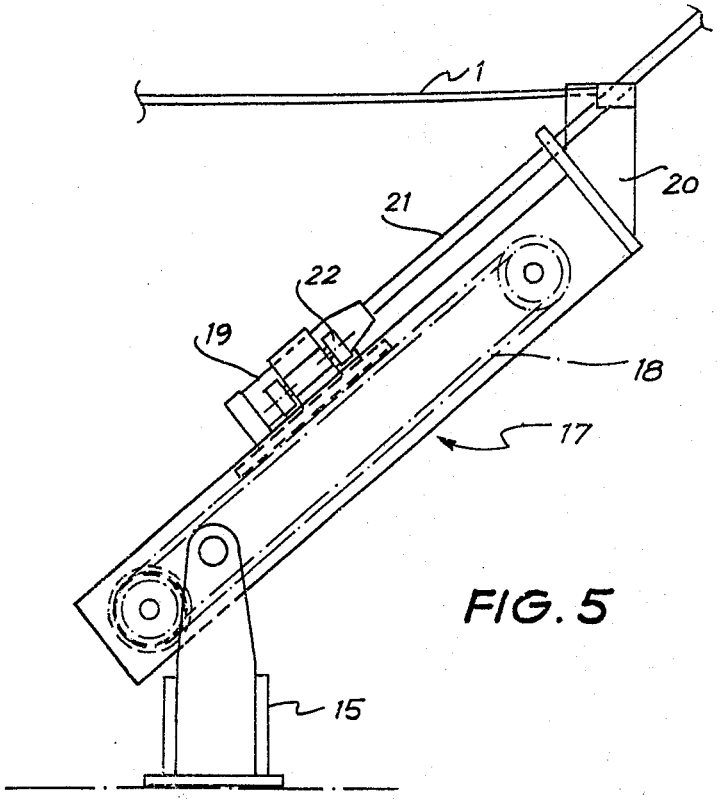
FIG. 5
FIG. 6
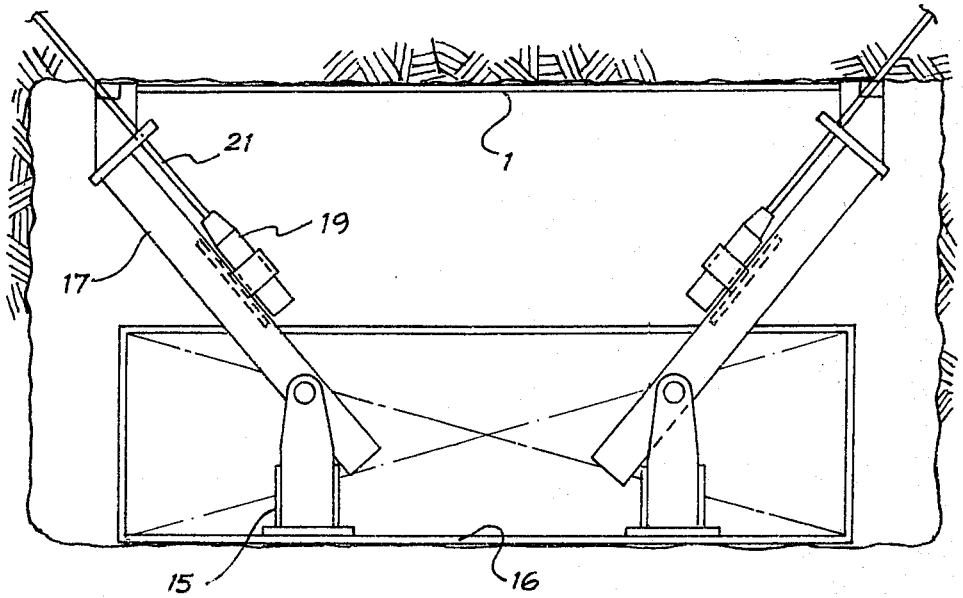

PRESTRESSED ROCK TRUSS

The present invention relates to an improved system of roof support in mines and in particular to a prestressed rock truss and an apparatus for installation thereof.

Conventional roof supports consist of prop and lid, cross timber, roof bolts, roof bolts and W-straps, steel arches, and Birmingham slings. Most of these support systems are time consuming to install and provide no warning of any roof movement. The steel arches and Birmingham sling are both costly and take considerable time to install.

The present invention overcomes these problems by providing a roof support which is relatively cheap to produce easy to install, and provides a warning of any roof movement and hence prevents instantaneous dropping of the roof in the case of failure of the support.

In another form the present invention comprises a method of supporting a roof of a mine comprising the steps of placing an elongated truss with toggles at each end thereof against the roof to be supported, exerting a force against the toggles such that the truss is under tension, drilling bolt holes in roof, using a hole in each of the toggles as a guide, at an angle to the roof installing roof bolts into said bolt holes through said holes in the toggle such that the bolt holes extend beyond the width of the mine gallery, and securing said roof bolts to said toggles and in said bolt holes.

The invention will now be described by way of example with reference to the accompanying drawings in which:

FIGS. 5 and 6 show the installation of the rock truss by means of using a continuous miner;

Figure 1:
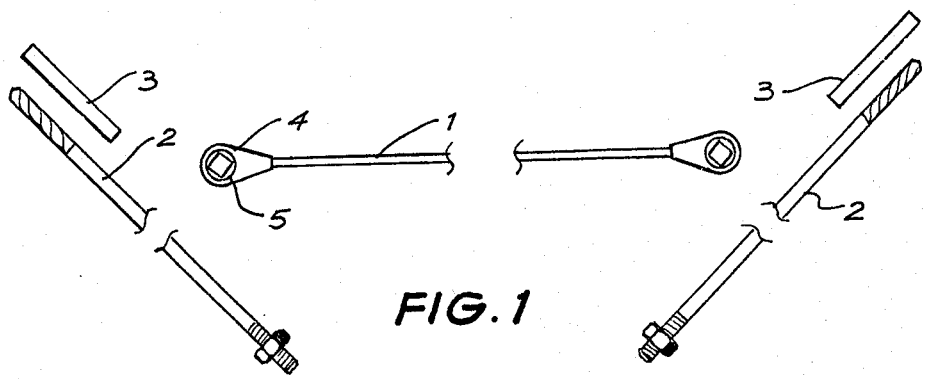
FIG. 1 shows the components for one embodiment of the roof support.
Figure 7A:
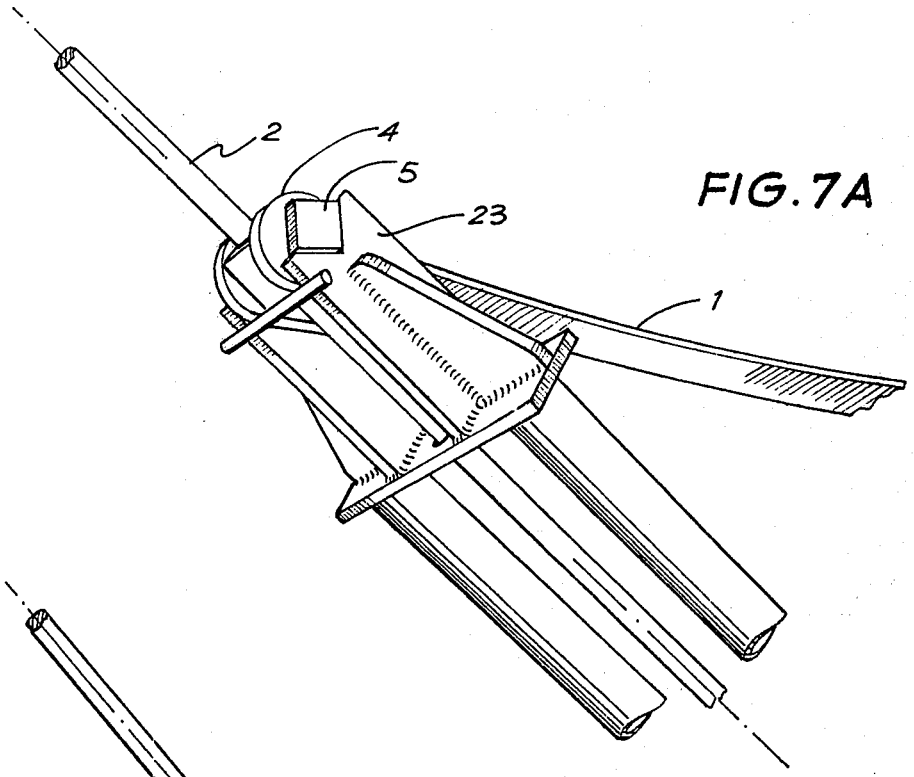
FIG. 7 shows a close up view of a toggle of one embodiment of the invention held in an installation apparatus.
Figure 7B:
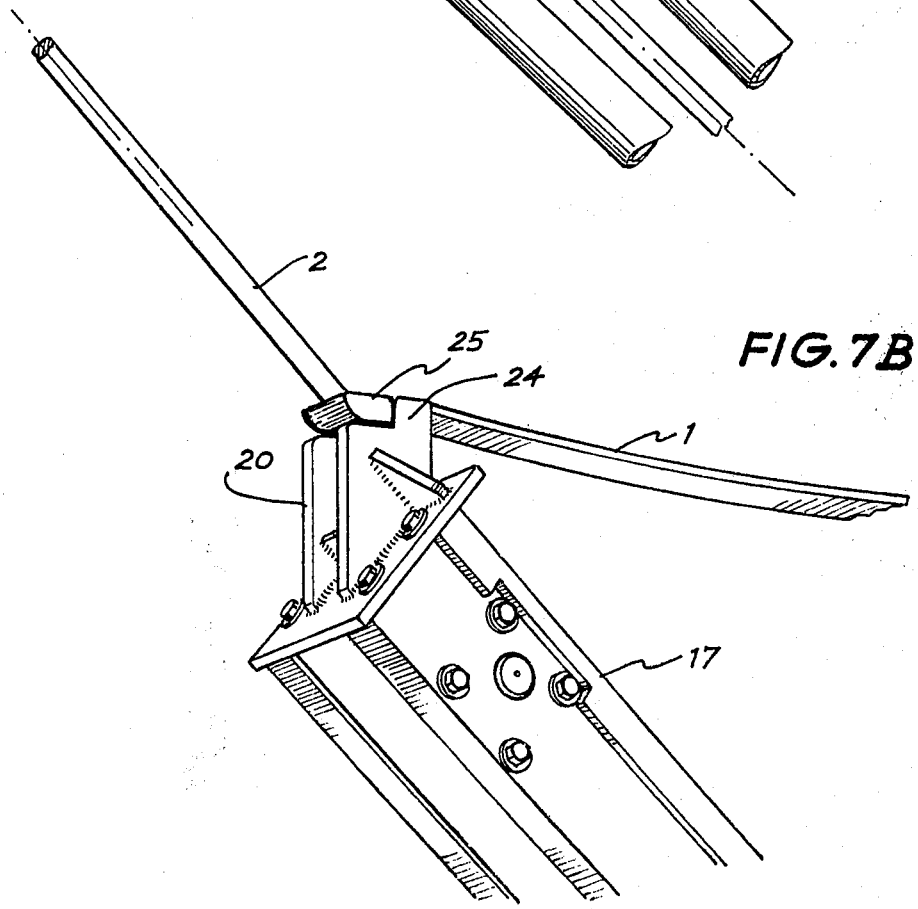

The components of the rock truss assembly shown in FIG. 1 consist of the truss (1) itself, two roof bolts (2) and resin cartridges (3) used to secure the bolt in the bolt hole. Each end of the truss (1) has a toggle (4) having a hole through which a roof bolt can pass. A detail view of this is seen in FIGS. 7A and 7B in which the truss is held in an installation apparatus shown in FIGS. 5 and 6 respectively.

The toggle 4 has a projection 5 which fits into a claw 6 of the installation apparatus so as to position the hole (not shown) in the toggle 4 so that the bolt hole in the roof is drilled at the correct angle.

In FIG. 1 resin cartridges are shown to secure the bolt in the bolt hole. However any suitable means can be employed; such as slot and wedge or expansion shell constructions.

Figure 2:
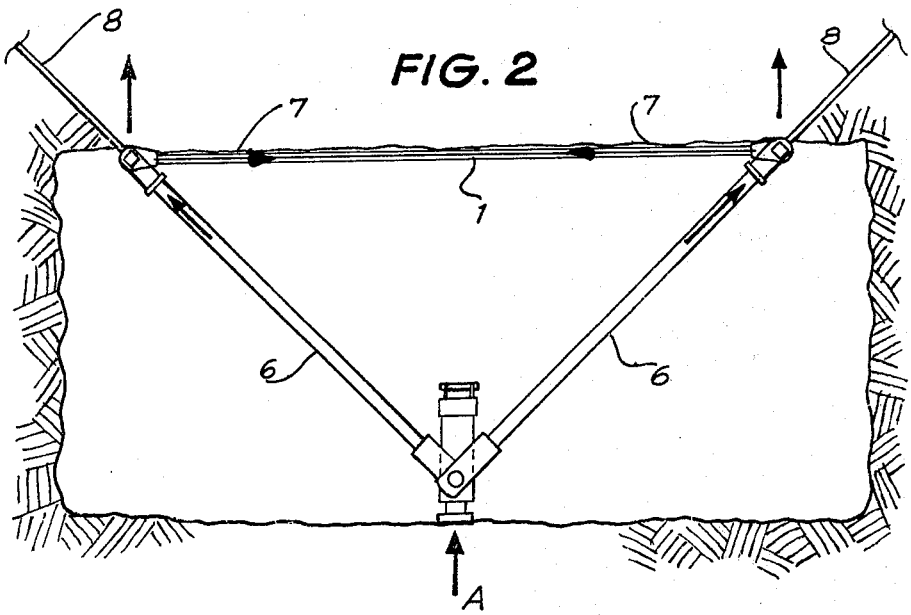
FIG. 2 shows a schematic representation of the forces acting upon the truss during pretensioning.

In the initial stages of installation prior to drilling the truss is supported against the mine gallery roof and an upwardly directed thrust A is applied which is transmitted by beam members 6 as shown in FIG. 2 resulting in a tensile force 7 being exerted on the truss 1. The directions of the forces are only approximate as no allowance is taken of friction between the roof and the ends of the truss.

The thrust A can be provided by the hydraulic system or in the case of the device being mounted on a front end loader or continuous miner or other mining machine by the upward movement of that part of the machine to which it is attached.

Figure 3:
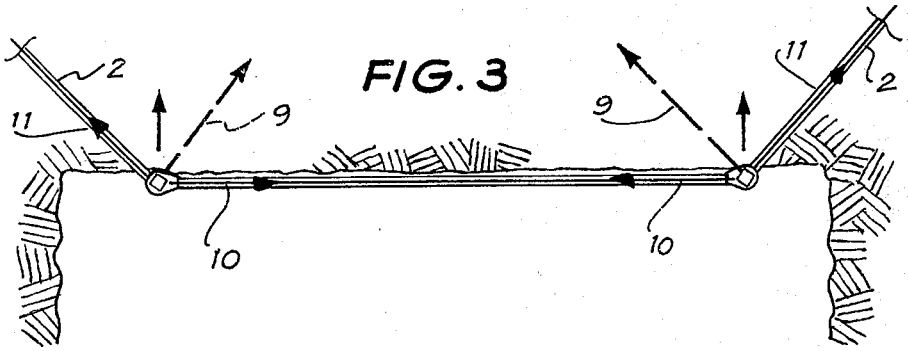
FIG. 3 shows the forces acting upon the roof support assembly after installation.

While the truss is under the tensile force 7 the bolt holes 8 are drilled. These holes could be drilled simultaneously in one pass. Preferably the holes are drilled at 45° to the roof. The bolts are then installed and the thrust A is removed and the drill slides removed. The operation is now complete and the main stresses are as shown in FIG. 3 with the resultant force 9 being produced as a result of the now compressive force 10 in the truss and the retention force 11 of the roof bolt 2.

It will be appreciated that the toggle serves three purposes:

It provides a solid, accurate drill guide, right on the roof.

It serves to accept the bearing pressure of the nut, as it is tightened on the bolt, eliminating the use of a bearing plate and spherical or tapered washers.

In one embodiment the toggle can rotate slightly, precisely at the angle between the bolt and the truss to permit the maximum possible evenness in the redistribution of tension in the bolt and the truss, particularly if the roof sags and tends to elongate the bolts and truss.

Pieces of timber and/or wedges may be inserted between the roof and the truss, before or after its installation, to give visual and audible warning of any roof movement.

If the roof pressures are such as to cause the roof to sag down, elongating the truss, the bolts and truss continue to provide constant support, gradually elongating the steel until its ultimate breaking strain is reached.

In the case of almost any other method of support, except for steel arches, failure of the support usually results in almost instantaneous dropping of the roof.

This is often the case with vertical roof bolts where guttering occurs at the sides of the opening.

In this case the roof, the bolts and their anchorages may all drop without warning.

The truss, however, is anchored beyond the sides of the opening.

Figures 4, 8:
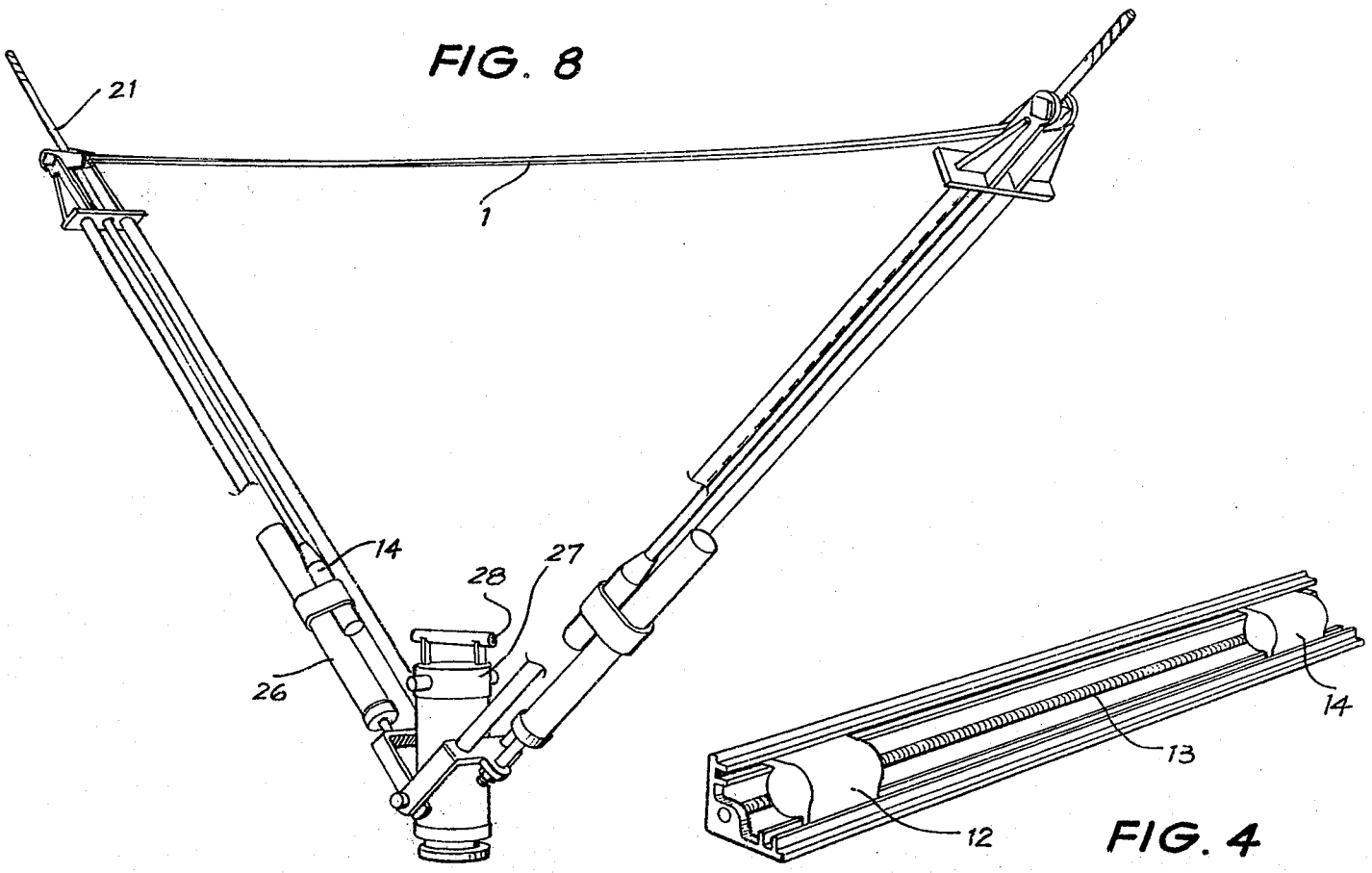
FIG. 4 shows a schematic representation of portion of apparatus used to install the rock truss.
FIG. 8 shows a view of the installation apparatus of FIG. 7.

An apparatus is shown in FIG. 4 and FIGS. 7 and 8 for the installation of the truss and the roof bolts. The apparatus comprises in general a drill motor 12, a feed screw 13 and a feed screw motor 14.

However, any suitable type of drilling and type of power source can be used. Such forms are electric rotary, hydraulic rotary or percussive or compressed air rotary or percussive.

The apparatus could be carried by hand as shown in FIG. 8 and is compressed air operated or it could be fitted to a continuous miner or the bucket of an underground front end loader as shown in FIGS. 5 and 6.

The exact method of installation will depend on the length of bolt deemed necessary, the width of the gallery, the length of the truss, and whether installation is required behind or near the front of the continuous miner. A variation of the hand carried apparatus shown in FIG. 8 could be used on a continuous miner in a similar way to the setup as shown in FIGS. 5 and 6.

FIGS. 5 and 6 show one embodiment of a device with which to install the roof bolt system of the present invention. This type of device is designed for mounting on movable members of underground machines, such as illustrated in FIG. 6, for example to the bucket 16 of an underground front end loader (not shown).

The device is attached by way of its supports 15 to the bucket 16. The arm 17 is set at the appropriate angle and the hydraulic rotary drill motor 19 spins the drill 21. In this case the drill motor 19 is urged up the arm 17 by means of a chain drive 18 to carry out the drilling operation. Any drive of course such as hydraulic or other mechanical means could be used for this operation. In the present example the drilling consists of two steps as the amount of travel of the drill does not permit a one-step drilling step. Thus the hole is drilled for example to half the length of the bolt and then the drill removed and the full length drill inserted into the bored hole and the drill connected to the drill motor and the hole drilled the proper length. The drill is then withdrawn and the motor 19 is flipped out of the way on hinge 22 and a rock bolt inserted through the hole in toggle 5 of the rock truss and fastened by any suitable means in the bored hole. When the truss is secured by the two bolts which extend beyond the width of the gallery the bucket 16 is lowered and the front end loader moves to the next roof truss fixing position and the procedure repeated.

A portable device for the installation is shown in FIG. 8, wherein compressed air is supplied to each of the rotary compressed air drills 14 and the three stage telescopic air cylinders 26 and the setting and presetting cylinder 27 by way of airlines and valves (not shown). The telescopic air cylinders 26 supply the thrust, to place the truss in tension and for drill penetration. The cylinder 27 has a release button 28 to enable the cylinders 26 to return to their unextended positions.

FIGS. 7A and 7B show the end of the installation apparatus showing two types of fittings adapted hold the rock truss 1 in position for installation. In FIG. 7A a rock truss having the projection 5 on the rotatable toggle 4 is supported by a claw 23 of the arm such that the hole through the toggle is correctly aligned. In FIG. 7B the projection 25 of the rock truss 1 is fixedly attached thereto and is held in its correctly aligned positioned by the claw 24.

A further embodiment comprises a steel beam, for example of light channel section, with a wedge shaped steel block near each end situated on the side of the steel beam remote from the mine roof.

The wedge would have a hold drilled therethrough to accept the roof bolt to provide for accurate drilling, and the upward and outward thrust would be applied against this wedge to prestress the truss.

If the roof is so incompetent and friable that mesh or close timber is required to support it, then this would still be required.

It would of course be necessary whatever the main method of support.

Hence, pre-stressed trusses would still show their cost and timesaving benefits.

In some exceptionally heavily stressed ground, in which steel arches may be considered necessary, it may be still preferable to reduce the truss spacing to, say, less than 1 foot apart.

In still other situations, it may be preferable to increase the cross sectional area of the bolts and truss to obtain proportionately higher tensile strengths.

What I claim is:

1. A method of supporting a roof of a mine gallery comprising the steps of placing an elongated truss with toggles at each end thereof against the roof to be supported; exerting a force against the toggles such that the truss is under tension; drilling bolt holes in the roof, using a hole in each toggle as a guide, at an angle to the roof; installing roof bolts into said bolt holes through said holes in the toggles such that the roof bolts extend beyond the width of the mine gallery; and securing said roof bolts to said toggles and in said bolt holes.

2. A method as claimed in claim 1, wherein said force exerted on each toggle is applied by way of an elongate frame member engaged at the upper end thereof with said toggle and aligned with the intended axis of said bolt hole.

3. A method as claimed in claim 2, wherein a vertically upwardly directed force is applied to the lower ends of each said elongate frame member and is transmitted thereby to provide said force exerted on each said toggle.

4. A method as claimed in claim 2, wherein said bolt holes are drilled in said roof by way of drilling apparatus supported by and axially aligned with said elongate frame members, and wherein the drill bit in said drilling apparatus passes through said hole in said toggle.

5. A method as claimed in claim 2, wherein said bolts are secured to said toggles by nuts threadedly engaged with said roof bolts and tightened against said toggles.

* * * * *